United States Patent [19]

Giesen

[11] 4,282,833

[45] Aug. 11, 1981

[54] HOT-WATER BOILER, FOR INSTANCE A CENTRAL HEATING BOILER, AND A METAL CASTING THEREFOR

[75] Inventor: Gerardus J. Giesen, Tegelen, Netherlands

[73] Assignee: Metaalgieterij G. Giesen, B.V., Tegelen, Netherlands

[21] Appl. No.: 41,793

[22] Filed: May 23, 1979

[30] Foreign Application Priority Data

May 23, 1979 [NL] Netherlands ..... 7805539

[51] Int. Cl.[3] ..... F22B 7/00

[52] U.S. Cl. ..... 122/158; 122/161; 122/183; 122/367 C

[58] Field of Search ..... 122/182 S, 1 A, 135 F, 122/6 A, 158, 161, 166 R, 183, DIG. 1, DIG. 7, 8, 9, 20 B, 235 A, 367 C

[56] References Cited

U.S. PATENT DOCUMENTS

| | | | |
|---|---|---|---|
| 669,738 | 3/1901 | Thomson | 122/367 C |
| 1,128,534 | 2/1915 | Schutz | 122/183 |
| 1,841,230 | 1/1932 | Vuia | 122/161 |
| 2,225,606 | 12/1940 | Beauvais | 122/161 |
| 2,787,256 | 4/1957 | Ilune | 122/182 S |
| 2,832,320 | 4/1958 | Thome et al. | 122/161 |

*Primary Examiner*—Henry C. Yuen

*Attorney, Agent, or Firm*—Stevens, Davis, Miller & Mosher

[57] ABSTRACT

A hot water boiler, particularly for central heating systems, has a double-walled structure containing water passages and bounding a combustion chamber, and a multi-walled structure outside the double-walled structure providing passages for the combustion gases and the incoming air for combustion. In order to increase thermal efficiency, while providing an economic and simple design, the double-wall structure is a pair of opposed hollow metal castings which bound not only the combustion chamber but also a combustion gas passage leading upwardly from that chamber and having in it projections integrally formed on the castings. Outside the castings are walls providing, in sequence, downward and upward passages for combustion gas and a downward passage for combustion air.

10 Claims, 7 Drawing Figures

HOT-WATER BOILER, FOR INSTANCE A CENTRAL HEATING BOILER, AND A METAL CASTING THEREFOR

BACKGROUND OF THE INVENTION

1. Field of the Invention

This invention relates to hot water boilers, and particularly such boilers for use in domestic or other central heating systems. The invention also relates to hollow metal castings suitable for use in such boilers.

2. Description of the Prior Art

The object of the present invention is to provide a hot water boiler which can have a thermal efficiency exceeding 86% or even 90%, and at the same time can be manufactured at low cost and occupies a small amount of room.

The invention as claimed is intended to solve this problem. It proposes improvement of the heat exchange between the combustion gas and the water by locating the water passage in double-walled metal castings which have integral projections projecting not only into a passage for combustion gas outside the casting but also into a combustion gas passage leading out of the upper end of the combustion chamber. Additionally, further passages are arranged, in a triple-wall casing structure, for heat exchange between the combustion gas and inflowing combustion air.

In view of the rise in energy costs in recent years, there has been a distinct need for designs of hot water producing apparatus of higher thermal efficiency. In this connection there have been proposed central heating boilers which are provided with additional insulation, or the flue gas exhaust of which has an additional heat exchanger. This and similar designs have proved to result in only limited improvements in thermal efficiency, but they do tend to cause a steep rise in cost as well as in the space required by such boilers. It should be mentioned that a conventional method of expressing the thermal efficiency of gasfired boilers is based on the calorific top value of the fuel, ie. the accepted upper limit of the calorific value of the fuel. In conventional designs of hot water boilers, it is not possible in a simple way to achieve a thermal efficiency of over 80% on the water side, defined in this way.

SUMMARY OF THE INVENTION

The object of this invention is to provide a hot water boiler which has a thermal efficiency exceeding 86% and is even as high as 90%.

It is another object of the invention to provide a hot water boiler which can be manufactured at low cost and which occupies a small amount of room.

The hot water boiler of the invention has a double wall structure containing passages for flow of the water being heated and providing bounding walls on at least two opposite sides of a combustion chamber. Outside said double wall structure is a plurality of further walls providing passages for flow of combustion air and combustion gases whereby the combustion gases exchange heat with the water and the air for combustion. The said double-wall structure has vertically extending first projections on its outside face which project into a said passage for combustion gas. The said double-wall structure is provided, in a manner known per se, by opposed hollow metal castings which provide opposite walls of the combustion chamber and further provide opposed bounding walls of a combustion gas outlet passage extending upwardly from the combustion chamber. The castings have second projections extending into said combustion gas outlet passage. Outside each of the castings, three walls provide, in sequence in the outward direction, firstly a first passage for downward flow of the combustion gases from the said outlet passage over the surfaces of said first projections on the outside of the castings, secondly a second passage for upward flow of the combustion gases from said first passage and thirdly a passage for downward flow of combustion air which is connected into the bottom of the combustion chamber.

In comparison with, for instance the hot water boiler of U.S. Pat. No. 2,787,256, the boiler of the invention has—besides high thermal efficiency—the following advantages and differences.

In the first place, with the invention there is no need for a second double-walled body with water channels acting as a recuperator, which leads to a much simpler design, in which much external ductwork can be omitted. In the second place, the prior art boiler has no flue gas exhaust, so that a power burner is required to force the combustion gases through the relatively narrow and long passages.

Thirdly, in the boiler of the invention, combustion is in an upwards direction instead of a downwards direction. If the water in the water passages flows upwards, heat exchange on the combustion chamber side is consequently concurrent and on the exterior side of the water passages is countercurrent.

Fourthly, in the prior art hot water boiler combustion air is conducted first downwardly and then upwardly while with the invention the combustion air is preferably conducted downwardly only. Also, the castings used in the present invention can be used side-by-side to provide a larger boiler, whereas the prior art boiler is cylindrical, and does not lend itself to adaptation using the same components.

Finally, the use of castings for the body with water channels with the invention is much cheaper than the use of steel plate.

In the boiler of the invention, because the castings are heated on both sides by the hot combustion gases, they are less liable to inequalities in thermal expansion, and consequently to the occurrence of thermal tensions within the system.

Preferably the said wall separating said second and third passages outside the casting has vertically extending projections on both its sides. This improves heat transfer between the combustion gas to the incoming air. This wall, ribbed on both sides can for example be shaped as an extruded profile. Another improvement of thermal efficiency may be achieved if the wall separating said first and second passages outside the casting is covered over at least part of its height and on at least one side, by a layer of insulating material.

It has appeared in tests that such intensive cooling of the combustion gases can be achieved in the boiler of the invention that the temperature in the gases finally is insufficient for an adequate natural chimney draught. For this reason it may be desirable to include a fan in the combustion gas exhaust system.

By fastening the castings to the casing structure it is possible to fix them in the desired position in relation to each other. A sturdier structure can be obtained by welding the castings to each other by means of end plates and/or a bottom plate. It is preferred according to the invention, however, to achieve a simpler and yet effective connection in which the two opposed castings each have at least one side or bottom wall which extends towards the corresponding wall of the other casting, and H-section elements embrace the respective opposed edges of these walls in order to join them together. The H-section profiles can firmly grip the edges of the bottom or side walls.

Although it is conceivable to manufacture the castings from a different metal, the use of light metal is greatly preferred for this purpose; on the one hand it can be cast very easily into complicated shapes, and on the other hand its use can result in marked reduction of weight. Besides, thermal efficiency can also be considerably improved in this way. Finally light metal, in particular aluminium, is very suitable on account of its resistance to corrosion by condensate.

It should be remarked that in Dutch patent applications Nos. 7102691 and 7606640, it is proposed to use light metal castings for a hot water boiler, but these proposals relate to massive castings, cast without cores, which are welded together to get hollow castings having passages within them.

The boiler of the invention may comprise only two castings arranged opposite to each other, alternatively boilers of greater capacity may be made from the same castings by combining two or more pairs of castings side-by-side into larger units. Literature provides enough information on the design in such a case of the water passages in each of the castings and in the castings joined together in order to achieve optimum water circulation and heating. It is not necessary to provide more details on this subject here.

INTRODUCTION OF THE DRAWINGS

The preferred embodiment of the invention will now be described by way of non-limitative example and with reference to the accompanying drawings, in which.

DESCRIPTION OF THE PREFERRED EMBODIMENT

Figure 4:
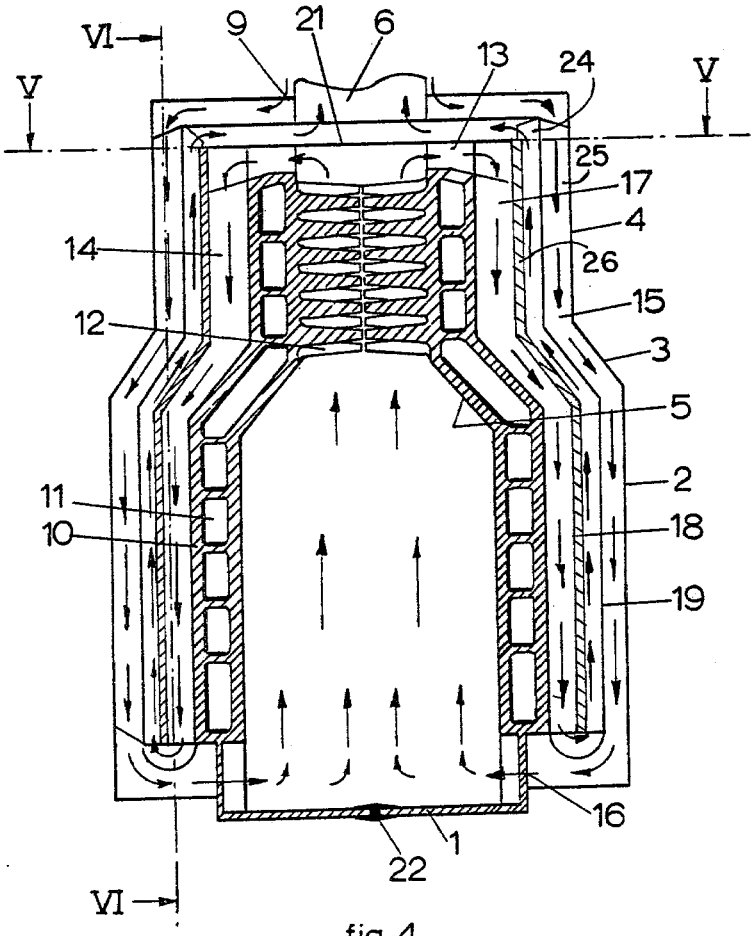
FIG. 4 is a cross-section on an enlarged scale and more detailed, on the line IV—IV of FIG. 3.

Referring to the drawings, the bottom 1 of the boiler consists of two bottom half plates, each forming an integral part of the two castings 5 (see shaded portions of FIG. 4). The boiler is further enveloped by a composite outer casing which is shown in three parts 2, 3 and 4, having a bent or cranked form. This shape is not essential, and particularly in the case of a high-load combustion chamber it is possible to design the castings and the casings as generally flat.

At its top the boiler is connected to a flue or combustion gas exhaust 6, which is connected to a chimney shaft 8 by a combustion gas fan 7 to provide draught for combustion, as described above.

Figure 1:
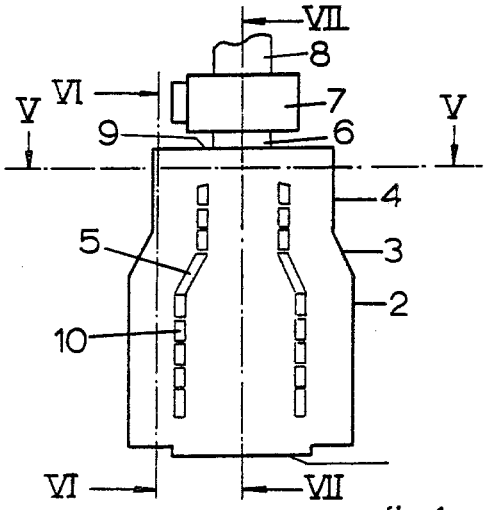
FIG. 1 is a schematic front view of the boiler embodying the invention.
Figure 2:
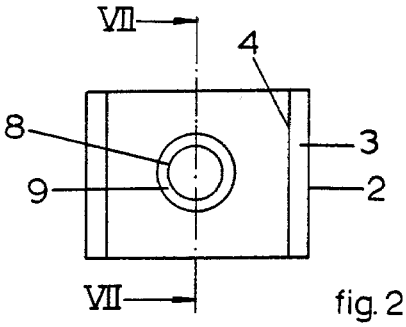
FIG. 2 is a schematic top view of the boiler of FIG. 1.
Figure 3:
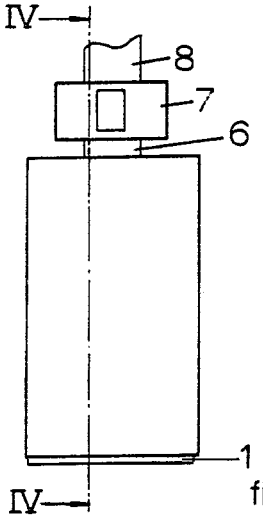
FIG. 3 is a schematic side view of the boiler of FIG. 1.

Around the exhaust pipe 6 there is an annular hole 9 in a top plate of the casing, through which combustion air is drawn into the boiler. In FIG. 2 the fan 7 is omitted, for clarity.

FIG. 4 which also does not show the fan 7 and the chimney shaft 8 shows that each of the castings 5 consists of an integrally cast double-wall structure 10 which contains two bends, as seen in vertical section. Between the double walls of each casting is a water passage 11, partitions causing this to have a folded or zig-zag path. The water passages 11 can be coupled to each other in series, but it is alternatively possible to have the two castings feed separate hot water circuits. The top end of each casting 5 has a large number or field or elongate finger-shaped projections 12 which point towards the corresponding projections of the other casting. In this manner a wide combustion chamber is provided between the castings 5 at the bottom of the boiler (with burners which are not shown), this chamber tapering off towards its top and joining immediately into a flue gas passage in which heat transfer to the water passages 11 is additionally effected by the finger-shaped projections 12. Further upflow of the hot gases is prevented by a plate 21, which deflects them horizontally between ribs 13 provided on the upper edge of the castings 5. Thereafter the gases pass into a downward flow passage 14 bounded by one casting 5 and a plate 18 forming one of the three walls of the triple-walled casing. The plate 18 is coated with a layer of insulating material 26 on one or both sides. In this passage the flue gases pass between outwardly projecting longitudinally extending vertical ribs 17 of the casting, thus transferring heat via these ribs 17 to the water in the castings.

The passage 14 bounded by the casting 5 and the casing plate 18 joins at the bottom of the boiler via a condensate trough into an upward passage which is bounded by casing plates 18 and 19 and which joins at its top end into the gas exhaust pipe 6. Between the plate 19 and the outer casing 2, 3 and 4 is a third passage 15, for downflow of incoming combustion air. The casing plate 19 is provided on both sides with vertical ribs 24 and 25 in order to improve heat transfer from the combustion gas to the combustion air, and with these ribs is formed as an aluminium extruded profile.

The combustion air is sucked into the top of the boiler via an aperture 9 and flows downwards in the passage 15 to enter the combustion chamber via gates 16. Burners (not shown) are supplied at the bottom of the combustion chamber. The design of these burners and the manner in which they are fitted in the boiler are conventional and need not be illustrated or described.

Figure 5:
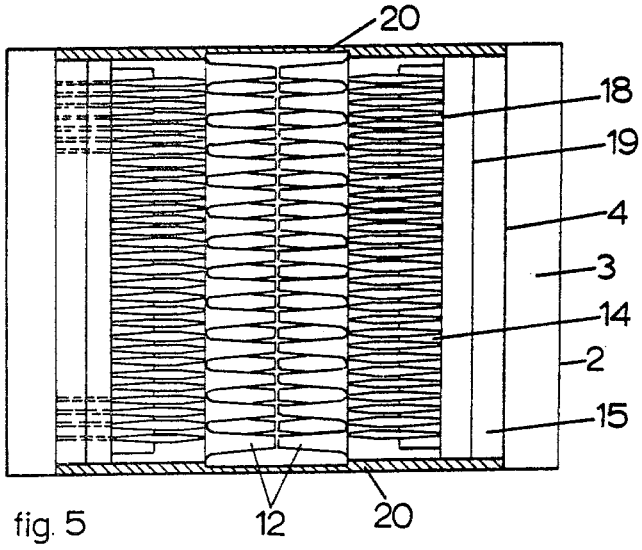
FIG. 5 is a cross-section on the line V—V of FIG. 1.
Figure 6:
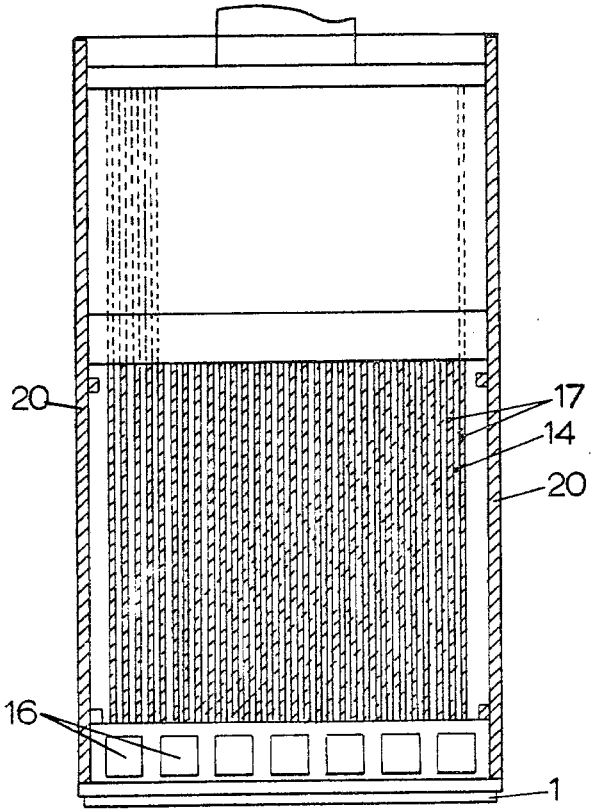
FIG. 6 is a cross-section on the line VI—VI of FIG. 1.
Figure 7:
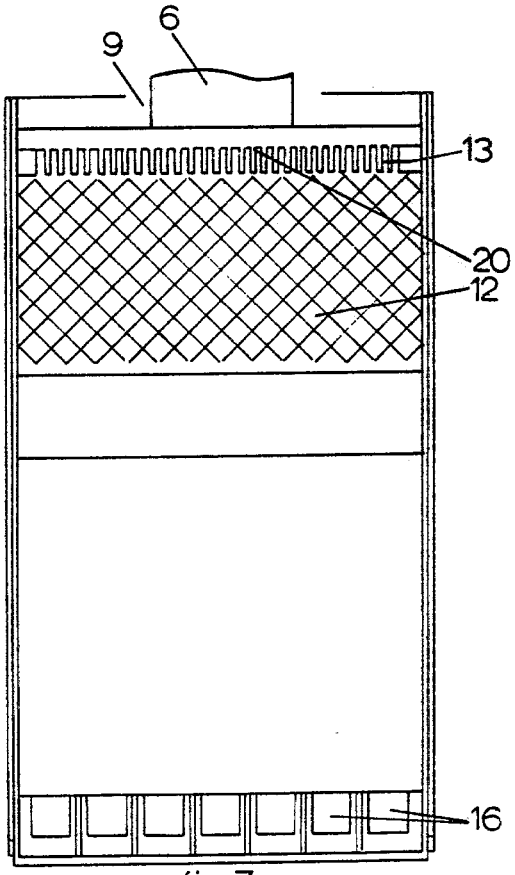
FIG. 7 is a cross-section on the line VII—VII of FIG. 1.

FIGS. 5 and 6 show in more detail how the castings 5 are enclosed in the boiler between end plates 20. The castings 5 can for example be fixed to these end plates 20 by welding, although other method of construction are also feasible. FIG. 4 shows the manner in which the bottom plates of the castings 5 are connected by means of an aluminium H-section profile 22 which embraces the opposed edges of these plates and grips them. If required this profile 22 can be secured to the bottom plates by means of screws. In an alternative embodiment, the end plates 20 are omitted, and the castings 5 may be designed with integrally cast side walls which can be connected to each other in a similar manner as the bottom plates, using an aluminium H-profile.

Although the boiler shown in the figures has only two castings arranged opposite each other, it is also conceivable to join two or more pairs of opposed castings together side-by-side in line into a larger unit with a large combustion chamber. These and similar variants of the present structure will be self-evident to an expert and no further details are required. All such modifications are considered to come within the scope of the present invention.

What is claimed is:

1. In a hot water boiler having a double-wall structure containing passages for flow of the water being heated and providing bounding walls on at least two opposite sides of a combustion chamber, there being outside said double-wall structure a plurality of further walls providing passages for flow of combustion air and combustion gases, whereby the combustion gases exchange heat with the water and the air for combustion, and the said double-wall structure having vertically extending first projections on its outside face which project into a passage for combustion gas, the improvement that the said double-wall structure is comprised of opposed hollow metal castings which provide opposed bounding walls of a combustion gas outlet passage extending upwardly from the said combustion chamber and have second projections extending into said outlet passage extending upwardly from the combustion chamber, there being outside each of the castings three walls providing in sequence in the outward direction firstly a first passage for downward flow of the combustion gases from the said outlet passage over the surfaces of said first projections on the outside of the casting, secondly a second passage interconnected with said first passage for upward flow of the combustion gases from the lower end of said first passage and thirdly a passage for downward flow of combustion air which is connected into the bottom of the combustion chamber.

2. A boiler according to claim 1 wherein the tops of the castings have upward projections which project into a passage connecting said combustion gas outlet passage above the combustion chamber and said first passage outside the casting.

3. A boiler according to claim 1 wherein the said wall separating said second and third passages outside the casting has vertically extending projections on both its sides.

4. A boiler according to any one of claims 1, 2 and 3 wherein the wall separating said first and second passages outside the casting is covered, over at least part of its height and on at least one side, by a layer of insulating material.

5. A metal casting adapted for use in a boiler according to claim 1 wherein said second projections are on its interior face adjacent its upper end.

6. A boiler according to any one of claims 1 to 3 wherein the castings are of light metal.

7. A boiler according to any one of claims 1 to 3 wherein a plurality of said castings, joined to each other, are provided on each of opposite sides of the combustion chamber.

8. A hot water boiler having (a) a combustion chamber, (b) a combustion gas outlet passage leading upwardly out of said combustion chamber, (c) at least two metal castings respectively providing bounding walls at opposite sides of said combustion chamber and combustion gas outlet passage, each said casting having inner and outer spaced walls constituting a double-walled structure and at least one passage between said spaced walls for water to be heated, (d) a plurality of elongate vertically extending first projections on said outer wall and cast in one piece therewith, said projections first projecting from the side of said outer wall more remote from the combustion chamber, (e) first, second and third casing walls forming a triple wall structure on the outside of each of said castings, a first said casing wall defining between itself and the outer wall of the adjacent casting at least one first passage arranged for the downward flow of combustion gas emerging from said combustion gas outlet passage with said first projections on said outer wall of the casting projecting into the said first passage, said first and second casing walls defining between them at least one second passage arranged for upward flow of the combustion gas emerging from the said first passage, and said third and second casing walls defining between them at least one third passage arranged for downward flow of air for combustion which third passage is connected at its lower end to the lower end of the combustion chamber.

9. A metal casting adapted for use in a boiler according to claim 8 which has a double-wall structure containing a passage for water and has a plurality of second projections on its interior face adjacent its upper end.

10. A casting according to claim 9 or claim 5 wherein said passage for water is shaped to provide a folded path for the water, and said second projections on its interior face are finger-like and elongate.

* * * * *